United States Patent [19]

Rousseau et al.

[11] 4,329,183

[45] May 11, 1982

[54] DECATIONIZATION OF AQUEOUS SUGAR SOLUTIONS

[75] Inventors: Gerard Rousseau, Ham; Claude Lamotte, Juan les Pins, both of France

[73] Assignee: Rohm and Haas Company, Philadelphia, Pa.

[21] Appl. No.: 154,656

[22] Filed: May 30, 1980

[51] Int. Cl.[3] ..... C13D 3/14

[52] U.S. Cl. ..... 127/46.2

[58] Field of Search ..... 127/46 A, 46.2

[56] References Cited

U.S. PATENT DOCUMENTS

| | | | |
|---|---|---|---|
| 2,388,224 | 10/1945 | Behrman | 127/46 A |
| 2,563,006 | 8/1951 | Collier | 127/46 A |
| 2,578,938 | 12/1951 | Kunin | 127/46 A |
| 2,926,110 | 2/1960 | Shimizu | 127/46 A |
| 3,156,644 | 11/1964 | Kunin | 127/46 A X |
| 3,250,702 | 5/1966 | Levendusky | 127/46 A |
| 3,961,981 | 6/1976 | Pollio | 127/46 A |
| 3,982,956 | 9/1976 | Schoenrock | 127/46 A |

*Primary Examiner*—Sidney Marantz

[57] ABSTRACT

Aqueous sugar solutions are agitated in a batch process with strong cation exchange resin, optionally mixed with anion exchange resin, or with a mixture of weak acid cation exchange resin in the hydrogen form an anion exchange resin, under closely defined time and temperature conditions to effect decationization or deionization without the degree of cooling and dilution required in conventional fixed bed processes. In the presence of strong acid cation exchange resin the temperature is 20° to 40° C. and the contact time between sugar and resin is at most 20 minutes, unacceptable levels of inversion thereby being avoided. When weak acid resin is used as the cation exchange resin the temperature is 20° to 90° C. and the contact time is at most 90 minutes. When mixed anion and cation exchange resins are used color bodies are removed from the sugar solution.

5 Claims, No Drawings

DECATIONIZATION OF AQUEOUS SUGAR SOLUTIONS

This invention is concerned with the decationisation of (i.e. complete or partial removal of cations from) aqueous sugar solutions.

The field to which the invention relates is the purification of solutions in sugar refineries or mills which are at least decationised and possibly also deanionised and/or decolorised using ion exchange resins.

In conventional ion exchange processes for the decationisation of aqueous sugar solutions, the solution is passed in a fixed bed process, through a bed of ion exchange resin containing strong acid cationic exchange resin in the hydrogen form. However, it has been necessary to cool the sugar to minimise inversion which takes place when sugar is subjected to a low pH, as is inevitable at the exchange sites in a strong acid cation exchange resin, for the time required for the sugar solution to pass through the bed within acceptable hydraulic parameters, that is to say without an unacceptable pressure drop. Since cooling down to about 10° C. is needed, this significantly increases the viscosity of the sugar solution and so the problem is compounded, and the sugar solution has usually been diluted to offset this effect, at least in part. The diluted solution has eventually to be reconcentrated and this, of course, is wasteful in power consumption.

It is known from Italian Pat. No. 641205 to treat sugar solutions in a batch process with ion exchange resins. Batch treatment, wherein sugar solution and ion exchange resin are mechanically agitated together does not demand that the sugar solution be as low in viscosity as in a process wherein the sugar solution must flow through a fixed bed of resin. This specification, however, does not teach how to avoid inversion of raw sugar soution which is contacted with strongly acid cation exchange resin in the hydrogen form other than in a mixed bed of anion and cation exchange resins. Furthermore, the teaching is wholly silent as to the nature of the resins used, for example whether they are strong or weak electrolyte resins.

We have now unexpectedly found that raw sugar solution can be successfully decationised without the conventional degree of cooling and therefore without the need to dilute as much, or at all, in a batch process by contacting it with a strong acid cation exchange resin in the hydrogen form under closely defined time and temperature conditions without an unacceptable level of inversion taking place. Furthermore, we have found that inversion can be kept within acceptable limits and deionisation and some decolouration can be achieved by using, in a bath operation, strong or weak cation exchange resins in a mixed bed with anion exchange resin, usually in the hydroxide or free base form, at temperatures higher than have, as described above, conventionally been used with a fixed resin bed.

Accordingly this invention provides a process for the decationisation of an aqueous sugar solution wherein the solution is passed into contact with ion exchange resin in a batch reaction, agitated therewith and separated therefrom and wherein the resin (a) comprises strong acid cationic exchange resin in the hydrogen form, the temperature is from 20° to 40° C., preferably 25° to 30° C. and the contact time between the sugar solution and the resin is at most 20 minutes or (b) comprises a mixture of weak acid cation exchange resin in the hydrogen form and an anion exchange resin, the temperature is 20° to 90° C., preferably 40° to 90° C., most preferably 50° to 65° C., and the contact time between the resin and the sugar solution is at most 90 minutes.

Any strong acid cation exchange resin is useful in resin (a) in the process of the invention. Preferred resins are macroreticular styrene/divinylbenzene resins, such as Amberlite 200 or Amberlite 252 or the highly cross-linked gel resins, such as Amberlite IR-122 and Amberlite IR-124 commercially available from Rohm and Haas Company.

Any weak acid cation exchange resin can be used in admixture with the anion exchange resin in the deionisation and decolourisation process of the invention. The most preferred are acrylic acid/divinylbenzene resins such as Amberlite IRC-84 or methacrylic acid/divinylbenzene resins such as Amberlite IRC-50 also commercially available from Rohm and Haas Company.

The strong acid cation exchange resins can, and the weak acid cation exchange resins should, be used in the process of the invention in a mixed bed of resins containing anion exchange resins whereupon deionisation and removal of some colour bodies can be achieved. Any anion exchange resin can be used for this purpose. However, it is preferred to use acrylic anion exchange resins such as the macroreticular resin Amberlite IRA-35 and the gel resin Amberlite IRA-68 (both commercially available from Rohm and Haas Company) since these afford minimal regenerant requirement and optimal decolourisation efficiency.

The sugar solutions capable of being treated by the process of the invention may be any aqueous solution of sugar (including molasses) to be found, or which can be made up, in a sugar mill or refinery operation. The impurities generally contained in such solutions are those organic and mineral salts found in the sugar beet and sugar cane, such as betaine, pyrrolidone carboxylic acid, amino acids and sodium and potassium salts.

On contacting the cation exchange resin, either alone or in the mixed bed, the cations in these impurities will be exchanged for hydrogen ions and the exhausted resin will consequently need to be regenerated to remove the cations with which it is loaded.

It is surprising that a weak acid cation exchange resin can remove the indicated cations within the time and temperature constraints defined.

The anion exchange resin, when used, will partially or completely deionise the solution by removing the mineral and/or organic acids resulting from the cation exchange to liberate water, the anion exchange resin being in the hydroxyl (in the case of strong electrolyte anion exchange resins) or free base (in the case of weak electrolyte anion exchange resins) form. The exhausted ion exchange resin will therefore need to be regenerated to remove the exchanged ions and reconvert it to hydroxyl functionality or free base form.

Additionally, the anion exchange resin will remove colour bodies usually present in the sugar solution and these can be eluted from the resin along with the exchanged ions during regeneration.

Regeneration of the cation exchange resin can be effected in known manner by contacting the exhausted resin with strong mineral acid.

Regeneration of the anion exchange resin, and removal of colour bodies therefrom, can conveniently be achieved by contacting the resin with a solution of strong base, in the case of a strong electrolyte resin, or with ammonia or a solution of a strong base in the case of a weak electrolyte resin.

The concentrations of solutions which can be treated by the process of this invention may be as high as 88 Brix. This is of course much higher than the concentrations treatable by prior art fixed bed processes. The solutions treated may already be present in the sugar mills or refineries at the indicated concentration or any existing refinery or mill streams which have lower Brix values can be concentrated, for example by evaporation or mixing to increase their Brix values. Thus, the invention can be used to treat standard syrup, poor strike machine syrups and molasses.

The proportions of resin to sugar which would effectively decationise and deionise the sugar solution depend, amongst other things, on the level and nature of the impurities, the resin chosen, the temperature, concentration and time of contact and will optimised by trial-and-error experimentation in any particular case. The ratio may be expressed as a ratio of resin volume (mls) to weight of non-sugar (grams) impurities. Depending on the operating conditions, this ratio would generally be 1.0 to 3.0, most usually 1.2 to 1.6, for decationisation alone.

For deionisation in a mixed bed of weak electrolyte resins, from 35 to 75 grams of non-sugar per liter of mixed resin can be removed from the sugar solution in a bed containing a ratio of cationic to anionic resin of 1:1.5 to 1:5, in 0.5 to 1.5 hours.

As to the conditions used in the process of the invention, for decationisation alone we prefer to operate at a temperature of fro 20° to 40° C. preferably 25° to 35° C. using a contact time of 3 to 15 minutes, preferably 5 to 10 minutes. Under these conditions solutions having a concentration of 60 to 78 Brix can effectively be treated.

For deionisation using a mixed bed containing strong cation and, usually weak, anion exchange resins we prefer to use the same temperatures and a contact time of 5 to 20 minutes, preferably 10 to 20 minutes, more preferably 10 to 15 minutes. We also prefer a cation to anion exchange resin ratio from 1:1 to 1:5.

For deionisation using a mixed bed of weak electrolyte resins we prefer to use temperatures from 20° to 90° C., more preferably 40° to 90° C., most preferably 50° to 65° C., and a contact time of 60 to 90 minutes. Under these conditions solutions up to 88 Brix can be treated.

Some preferred embodiments of the invention will now be described for the purposes of illustration only, in the following Examples in which all percentages are by weight unless otherwise specified.

EXAMPLE 1

Decationisation 250 grams of poor strike machine syrup were stirred for 10 minutes, at 30° C. and in a 500 ml beaker with 52 ml of AMBERLITE 252 in its $H^+$ form (a macroreticular strong cation resin). The mixture was then transferred to a sintered glass filter and the treated syrup was analysed, after filtration, giving the following results:

| | Poor Strike Machine syrup | Treated syrup |
|---|---|---|
| Brix | 69.1 | 65.1 |
| Sugar % | 53.5 | 50.6 |
| Purity | 77.4 | 77.7 |
| Non sugar | 15.6 | 14.5 |
| pH | 7.0 | 3.7 |

-continued

| | Poor Strike Machine syrup | Treated syrup |
|---|---|---|
| $K^+$ (%) | 1.58 | 0.67 |
| $K^+$ (% Brix) | 2.29 | 1.03 |
| $K^+$ removed (%) | — | 55.0 |
| Percent Inversion | — | none |

EXAMPLE 2

Deionisation using a Strong Acid/Weak Base Monobed

200 Grams of sugar syrup were stirred for 20 minutes, at 30° C. and in a 500 ml beaker with a mixed bed of resin comprising 41 ml of AMBERLITE 252 and 78 ml of AMBERLITE IRA-68, in the $H^+$ and free base form respectively. The mixture was then transferred to a sintered glass filter and the treated syrup was analysed after filtration giving the following results:

| | Raw syrup | Treated syrup |
|---|---|---|
| Brix | 69.0 | 60.2 |
| Sugar % | 63.7 | 58.9 |
| Purity | 92.3 | 97.8 |
| Non sugar % | 5.3 | 1.3 |
| pH | 8.8 | 5.7 |
| Colour (% Brix) | 1670 | 150 |
| $K^+$ (%) | 0.58 | traces |
| $Na^+$ (%) | 0.09 | traces |
| Percent Inversion | — | none |

EXAMPLE 3

Deionisation Using a Weak Acid/Weak Base Monobed

250 Grams of a mixture of sugar syrup and poor strike machine syrup were stirred for 90 minutes at 60° C. and in a 500 ml beaker with a mixed bed of resin comprising 41 ml of AMBERLITE IRC-84 and 78 ml of AMBERLITE IRA-35, in the $H^+$ and free base form respectively. The mixture was then transferred to a sintered glass filter and the treated syrup analysed, giving the following results:

| | Mixture of syrups | Treated syrups |
|---|---|---|
| Brix | 68.6 | 64.7 |
| Sugar % | 61.7 | 61.1 |
| Purity | 90.0 | 94.4 |
| Non sugar (%) | 6.9 | 3.6 |
| pH | 8.7 | 6.6 |
| Colour (% Brix) | 2420 | 310 |
| $K^+$ (%) | 0.61 | 0.13 |
| $Na^+$ (%) | 0.24 | 0.05 |
| Percent Inversion | — | none |

EXAMPLE 4

Deionisation using Weak Acid/Weak Base Monobed

In to a column 5.1 m high and 0.3 m diameter were placed a mixture of 28.5 l of AMBERLITE IRC-84 and 57.0 l of AMBERLITE IRA-35 accounting for 40 cm and 88 cm of bed height respectively. 53 cycles of loading and regeneration were carried out treating a 69.7 Brix sugar solution containing 91.5% by weight sucrose and 8.5% by weight non-sucrose on a solids basis. The non-sucrose was predominantly amino acids, other acids, colour bodies, sodium and potassium salts. In each loading cycle the resin was agitated (by passage upflow of preheated air) for 80 minutes at a temperature of 65° C. with the sugar solution. After loading the resins were separated by upflow of very dilute sugar solution, rinsed with deionised water and regenerated with dilute sulphuric acid and ammonium hydroxide by standard procedures. Before the next loading cycle the resins were re-mixed.

The purity of the treated sugar was increased to 94.5% (from 91.5%) and 75% of the colour bodies were removed as was 62% of the potassium. The sucrose yield is increased by 1.5 times the weight of non-sucrose removed.

Comparative Calculation

Extrapolating these results to compare a conventional system (fixed bed with strong sulfonic acid resin and weak carboxylic resin) with a system operated according to Example 4 gives the following comparison. In order to obtain a direct comparison certain fundamental assumptions common to both systems have to be made. In this case we have assumed that sugar solution (syrup) to be treated is the product of the processing of 9,500 Tonnes per day of beet and that it has been decided to remove 44.2 Tonnes per day of non-sucrose from that solution.

| | Conventional IER System | System operated according to Example 3 |
|---|---|---|
| Percent total syrup treated | 30–40 | 100 |
| Influent syrup purity (sucrose content) | 91.5% | 91.5% |
| Total resin volume ($M^3$) | 253 | 105 |
| Cation resin volume ($M^3$) | 143 | 35 |
| Anion resin volume | 110 | 70 |
| Total no. of columns | 24 | 8 |
| Total vol. spent regenerant ($M^3$/day) (sulphuric acid and ammonia) | 1523 | 820 |
| Water used and to be evaporated in reconcentration of syrup (Tonnes/day) | 888 | 473 |
| Sulphuric acid regenerant (Tonnes/day) | 30.586 | 17.857 |
| Ammonia regenerant | 6.718 | 7.514 |

-continued

| | Conventional IER System | System operated according to Example 3 |
|---|---|---|
| (Tonnes/day) | | |
| Percent Decolourisation | 20–24 | 75 |

It can be seen therefore that capital and operating costs using the system of the invention can be much reduced over those of the prior art, and there is an additional advantage in the decolourisation achieved. Of course if the basic assumptions are changed the benefit may be obtained in terms of greater non-sucrose removal, and therefore sucrose yield, at the expense of some of the capital and operating cost savings.

"Amberlite" and "Monobed" are trademarks of Rohm and Haas Co., Philadelphia, United States of America.

Amberlite 252 is a macroreticular styrene/divinylbenzene strong acid cation exchange resin used in the $H^+$ form.

Amberlite IRA-35 is a macroreticular acrylic weak base anion exchange resin.

Amberlite IRA-68 is a gel acrylic weak base anion exchange resin.

Amberlite IRC-84 is a gel acrylic acid weak cation exchange resin.

We claim:

1. A process for the decationisation of an aqueous sugar solution wherein the solution is passed into contact with ion exchange resin in a batch reaction, agitated therewith and separated therefrom and wherein the resin consists essentially of a mixture of weakly acidic cation exchange resin in the hydrogen form and weakly basic anion exchange resin, the temperature is from 20° to 90° C. and the resin is in contact with sugar solution for about 60 to 90 minutes.

2. A process as claimed in claim 1 wherein the cation to anion resin volume ratio is 1:1 to 1:5.

3. A process as claimed in claim 1 wherein agitation is effected, at least in part, by passing air through the resin bed in contact with the sugar solution.

4. A process as claimed in claim 1 wherein the sugar solution has a concentration of up to 88 Brix.

5. A process as claimed in claim 4 wherein the temperature is 40° to 90° C.

* * * * *